US005116635A

United States Patent [19]

Rudbach et al.

[11] Patent Number: 5,116,635

[45] Date of Patent: May 26, 1992

[54] PROCESS FOR CONTROLLING THE FURNACE TEMPERATURE IN A MANUFACTURE OF HONEYCOMB STRUCTURES TREATED WITH PHENOLIC RESIN

[75] Inventors: Michael Rudbach, Echternach; Guy Weinand, Strassen, both of Luxembourg

[73] Assignee: Euro-Composites S.A., Echternach, Luxembourg

[21] Appl. No.: 513,907

[22] Filed: Apr. 24, 1990

[30] Foreign Application Priority Data

Feb. 3, 1990 [DE] Fed. Rep. of Germany ..... 4003249

[51] Int. Cl.[5] ..... B05D 1/04

[52] U.S. Cl. ..... 427/8; 427/235; 427/243; 427/345; 427/382; 427/430.1

[58] Field of Search ..... 427/345, 382, 8, 235, 427/243, 430.1

[56] References Cited

U.S. PATENT DOCUMENTS

| | | | |
|---|---|---|---|
| 1,309,454 | 7/1919 | Bradley | 427/235 |
| 2,723,923 | 9/1955 | Munters | 427/345 |
| 2,991,194 | 7/1961 | Cambron | 427/345 |
| 3,098,759 | 7/1963 | Lincoln | 427/379 |
| 3,226,251 | 12/1965 | Norton et al. | 427/382 |
| 4,028,472 | 6/1977 | Rosinski et al. | 427/8 |
| 4,068,016 | 11/1978 | Wilmanns | 427/8 |
| 4,421,781 | 12/1983 | Reznik | 427/345 |
| 4,469,720 | 9/1984 | Morris | 427/345 |
| 4,495,889 | 1/1985 | Riley | 427/8 |
| 4,525,389 | 6/1985 | Stemmler et al. | 427/345 |
| 4,731,175 | 3/1988 | Funk et al. | 202/160 |

FOREIGN PATENT DOCUMENTS

| | | | |
|---|---|---|---|
| 130962 | 12/1920 | United Kingdom | 427/345 |

*Primary Examiner*—Shrive Beck
*Assistant Examiner*—Diana L. Dudash
*Attorney, Agent, or Firm*—Collard, Roe & Galgano

[57] ABSTRACT

A process is disclosed for controlling the furnace temperature in a manufacture of phenolic resin-treated honeycomb structures from paper webs. The phenolic resin-treated honeycomb structures from the paper webs are, preferably, glued together and shaped to a body. Such body is immersed into a solution of a phenolic resin mixture and subsequently dried and cured in an indirectly heated furnace. The immersion and drying-/curing steps may be repeated several times and take place at a temperature in the range of 70° C. to 110° C., except for the last drying/curing step, which takes place at a temperature in the range of 145° C. to 155° C. For controlling the temperature, the substances contained in an air mixture exiting from the furnace are preferably condensed and subjected to fractionated distillation with the temperature of the furnace preferably being adjusted, based upon the quantities of organic and/or inorganic compounds obtained. The organic and/or inorganic compounds so obtained are recycled back into the process.

4 Claims, 2 Drawing Sheets

PROCESS FOR CONTROLLING THE FURNACE TEMPERATURE IN A MANUFACTURE OF HONEYCOMB STRUCTURES TREATED WITH PHENOLIC RESIN

The present invention relates, generally, to a process for controlling the furnace temperature in a manufacture of honeycomb structures treated with phenolic resin. More particularly, the present invention relates to a process for controlling the furnace temperature in the manufacture of phenolic resin-treated honeycomb structures, wherein such honeycomb structures include paper webs which are glued together to form a shaped body. Such shaped body is immersed in a solution of phenolic resin mixture and subsequently dried and cured in an indirectly heated furnace.

Honeycomb structures are an important construction material in the aviation industry and have to conform to a great number of material specifications. Most widely used is a honeycomb structure having an aramide paper impregnated with phenolic resin. For coating the honeycomb core, which is made of aramide paper, is repeatedly immersed in a solution of phenolic resin and subsequently dried or cured in a furnace.

The chemical reaction between phenol and formaldehyde is a polycondensation reaction in which homogenous or heterogeneous components are added to one another, forming large molecules, whereby a chemical bond of a plurality of reactive groups takes place with separation of by-products such as, for example, water. The polycondensation takes place step-by-step and may be interrupted at any desired point. For example, thread-like molecules may form first, which subsequently, in the next step, are extended, branched or cross-linked. Both a basic and an acid catalyst may be used in the reaction. The reaction product depends upon the catalyst used.

Great efforts have been made, since about 1970, to produce phenolic resins which are suitable for the manufacture of honeycomb structures from aramide paper. Such efforts, however, have met with only limited success. For this reason, the use of such honeycomb structures was possible only under certain conditions, until just a few years ago, in spite of the excellent properties such structures have with respect to resistance to fire and smoke.

A second generation of liquid phenolic resins had enhanced mechanical properties in the materials produced. With such resins, it was possible to improve the process for the manufacture of honeycomb structures through new machinery.

The drying or curing is accomplished by indirect heating in order to avoid formation of negative by-products, which may form with direct heating. In this way, the formation of organic compounds, which may be incorporated into the polymeric chains of the phenolic resin and which then impair the properties of the final products, is avoided to a high degree.

The components of the resin composition may be dissolved and later diluted in suitable solvents or solvent mixtures. Suitable solvents for phenolic resins are, for example, alcohols and ketones or their mixtures. Components of the resin compositions are, for example, phenol, formaldehyde, catalysts, water and polyphenols, which are also referred to as oligomers.

During the drying/curing step, the solvent can be withdrawn before the curing temperature is reached.

During curing, water is separated due to the polycondensation. Such water has to be withdrawn from the process as quickly as possible because water reduces the reactivity and, furthermore, represents an inclusion compound that impairs the optimal polycondensation.

The temperature and its control are consequently very important for controlling the process in an optimal manner during the drying/curing step. The temperature influences the duration of drying and curing and the quality of the finished product. Drying/curing is not carried out at a defined constant temperature, but rather within a temperature range that is varied at time intervals: For example, in a first interval, the temperature is raised to 70° to 110° C.; subsequently, in a second interval, it is kept constant, and finally, in a third interval, the temperature is raised to 150° C. Each layer of resin applied is completely cured in this way. The temperature increase per unit of time is of importance to the quality of the resulting final product. However, the problem with optimal temperature control is to determine, at any given time, the momentary degree of drying or curing.

Furthermore, in light of the current strict environmental protection standards which have to be met, it is of importance to be able to recover auxiliary process substances such as, for example, solvents after the process has been completed, and to recycle such substances back into the process.

Methods of solvent recovery are generally known to the art and are disclosed in, e.g., West German Patent Nos. 35 20 046 and 30 38 792, among others. However, with the method disclosed in these references, it is not possible to draw any conclusions concerning the optimal curing or drying temperature and rate to be applied.

Moreover, West German Patent No. 35 20 046 describes a process for the manufacture of phenolic resin-treated honeycomb structures for webs of paper which are glued together, whereby for producing the honeycomb structures, the webs of paper so glued together are pulled apart in order to form a body of a certain shape. For the purpose of eliminating mechanical stresses, the honeycomb core is heated and, for the purpose of fixation, repeatedly immersed in a phenolic resin/solvent mixture, and subsequently dried or cured in a furnace. By repeated immersion and drying and curing, several resin layers are applied to the honeycomb core, one on top of another. In order to reduce the number of immersions, it is deemed desirable to apply, with each immersion, a maximum quantity of resin without impairing the material properties of the final product. In such disclosed process, the quantity of resin applied is determined by the temperature curve, whereby the control of the temperature curve is determined empirically. However, no optimal control of the drying/curing step is possible with such process, so that a greater number of immersions is required and the material properties of the finished product are subject to wide variations.

It is, therefore, an object of the present invention to provide a process for controlling the furnace temperature in a manufacture for phenolic resin-treated honeycomb structures of the type specified above, so that optimal control of the drying/curing temperature and rate are achieved.

The foregoing and related objects are achieved by the present invention wherein a process is disclosed for controlling the furnace temperature in a manufacture for phenolic resin-treated honeycomb structures and paper webs. The phenolic resin-treated honeycomb structures from the paper webs are glued together and shaped to a body; such body being immersed in a solution of a phenolic resin mixture and subsequently dried and cured in an indirectly heated furnace. The immersion and drying/curing steps are repeated several times and take place at a temperature in the range of 70° to 110° C., with the last drying/curing step taking place at a final temperature in the range of 145° to 155° C.

The process according to the invention enhances the material properties of the phenolic resin-treated honeycomb structures, such as strength and elasticity. As opposed to the methods known to the prior art, the honeycomb structures obtained by the process according to the invention are characterized by increased strength, both in the direction of the glued joints of the individual paper webs (L-direction) and perpendicular thereto (W-direction). The ratio of the shear resistance L to W is equal, i.e., 1:1.

The enhanced material properties obtained by the process of the invention can be explained by the fact that in a drying process of up to 110° C., the polycondensation reaction is not yet fully completed, but complete only at a drying or curing temperature of about 150° C. Hence, further reactions may take place between the different resin layers resulting from the periodically implemented immersion and drying steps.

However, when the drying/curing step is immediately carried out at a temperature of up to 150° C., curing is complete, and interlinking of the different layers, leading to a certain embrittlement of the material, occurs to only a minor extent.

Further advantages of the present invention are described hereinafter.

Such advantages include, for example, for optimal temperature control, wherein the air mixture exiting from the furnace, which contains inorganic and/or organic compounds, is condensed. The condensate so obtained is subsequently subjected to fractional distilling with the temperature of the furnace being adjusted in accordance with the distillate quantities of inorganic and/or organic compounds obtained per unit of time.

With such control, the degree of drying/curing of the honeycomb core present in the furnace can be reliably specified at any time.

According to another beneficial feature of the invention, the substances obtained by the distillation are returned to the process by recycling. In this way, an absolute reduction of the load on the environment is achieved.

Other objects and advantageous features of the present invention will become apparent when considering the present invention in view of the accompanying drawing figures. It should, of course, be recognized that the drawing figures are intended as describing a preferred embodiment of the present invention and are not intended as a definition of the limits and scope of the invention.

Figure 1:
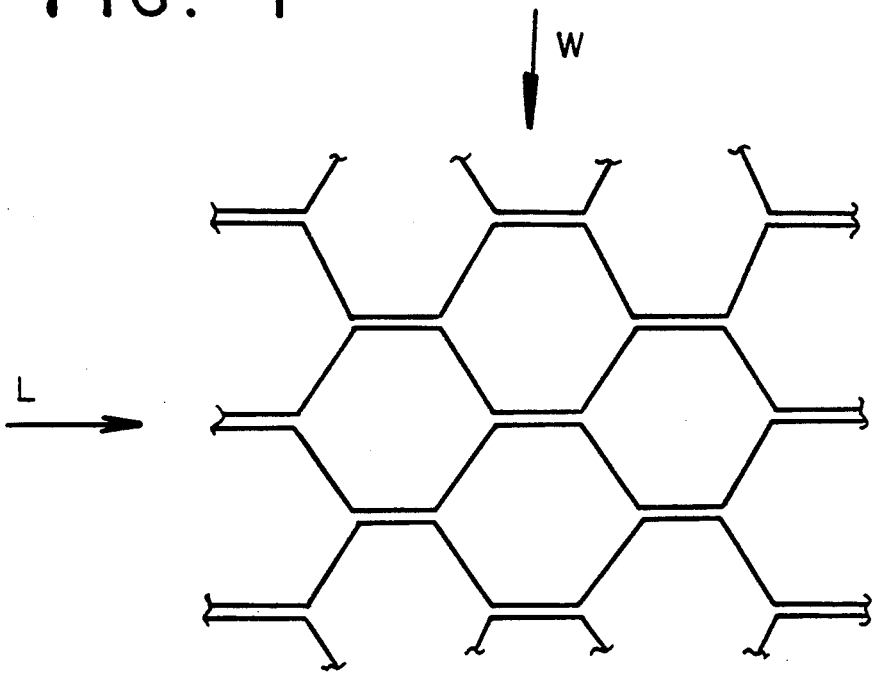
FIG. 1 shows a schematic part view of the honeycomb body.

Turning now, in detail, to a consideration of the drawing figures, FIG. 1 shows a top view of the honeycomb body having a plurality of webs of aramide paper glued to each other. Upon gluing, the webs of aramide paper have been expanded for shaping the honeycomb core. The latter is subsequently coated with phenolic resin. The strength of the finished honeycomb is determined by the shear stress, both in the direction of the glued joints (L-direction) and perpendicular thereto (W-direction), whereby the ratio of L to W is generally equal to 2 to 1.

Figure 2:
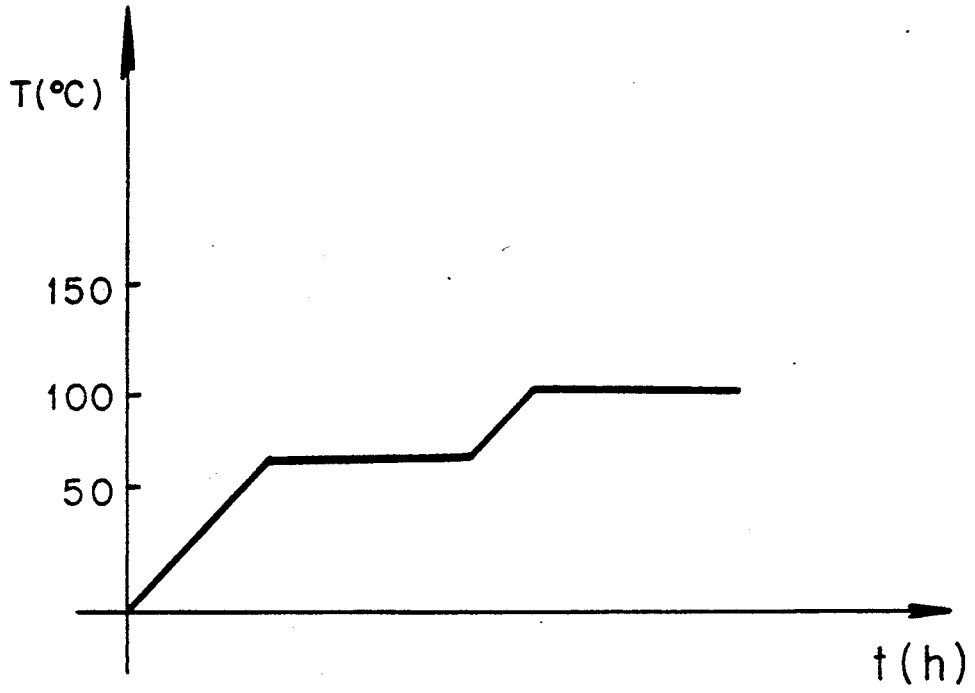
FIG. 2 shows a diagram of the temperature curve in the furnace during drying or curing.
Figure 3:
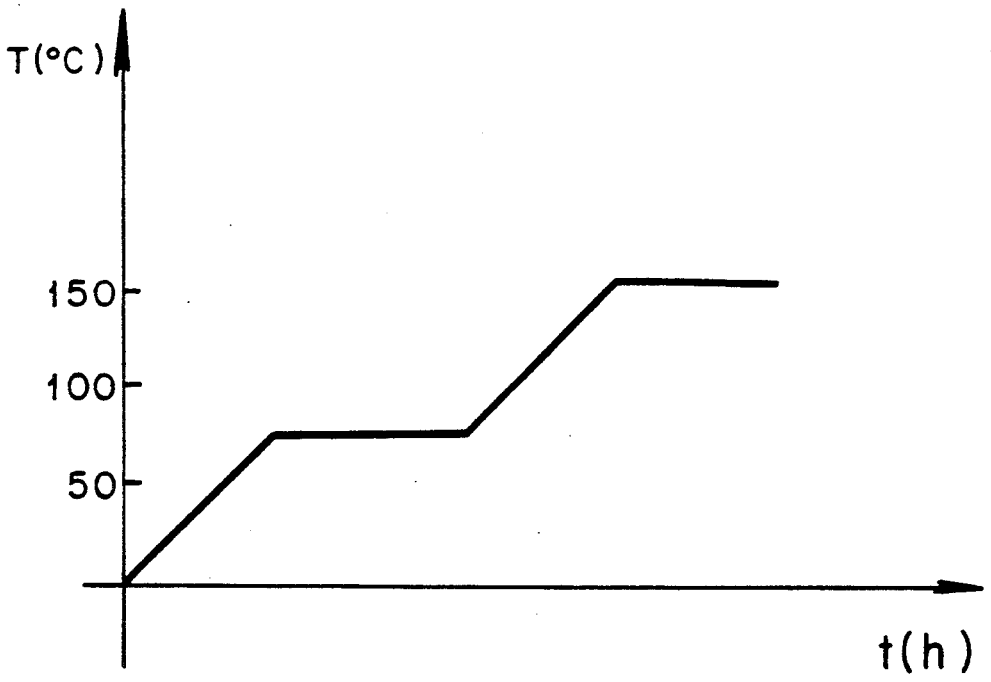
FIG. 3 shows a diagram of the temperature curve in the furnace during the last drying or curing step; and, FIG. 4 shows a diagram of the shear resistance of the honeycomb body as a function of the specific weight.

For drying or curing, the temperature of the furnace is preferably controlled, as shown in FIG. 2, i.e., during the first time interval, the temperature is raised to about 85° C.; then kept constant during a second time interval; and subsequently raised again during a third time interval to 110° C. Thereafter, the temperature is maintained constant during a fourth time interval. Subsequently, the honeycomb core is removed from the furnace and immersed again in order to apply another layer of resin. Once the desired resin thickness of the layers has been reached, the temperature is raised to 150° C. in a last drying or curing step during the third interval, and subsequently maintained constant in the fourth interval, as shown in FIG. 3.

Figure 4:
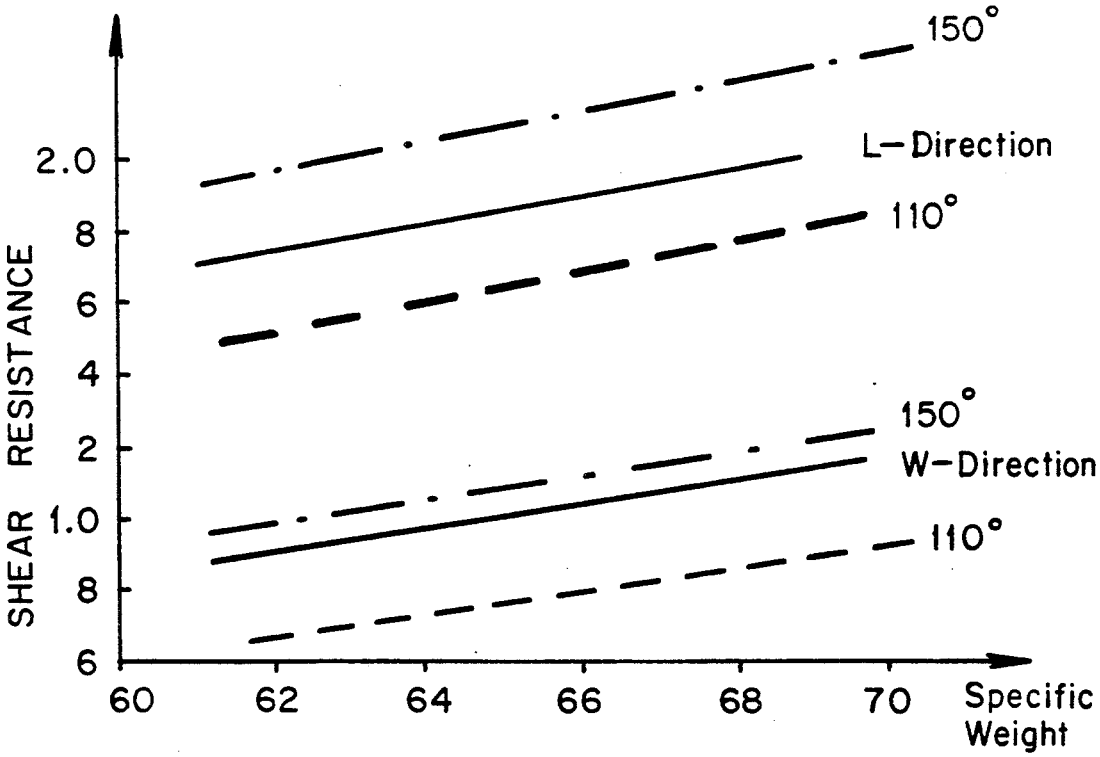

FIG. 4 shows a diagram for illustrating the dependence of the shear strength on the specific weight. While the drawn lines show the shear strength of the honeycombs obtained by the known methods in the L- and W-directions, the dash-dotted lines show the shear strengths according to the process of the invention. The dashed line shows the shear strength obtained after drying or curing at a temperature of up to 110° C.

For drying or curing, the immersed honeycomb core is admitted into a well-ventilated furnace. The initial temperature is set and the furnace is heated. Then, for controlling the furnace, either the total air mixture exiting from the furnace, said mixture containing inorganic and/or organic compounds, or only a part thereof, the latter being discharged via a bypass, is withdrawn and condensed in a condenser. Such condenser is, for example, a tube heat exchanger, which is cooled to about −20° C. to −30° C. with a water/glycol mixture.

The condensate so obtained is subsequently subjected to a one-stage or multi-stage fractionated distillation. Such distilling may be carried out continuously or in batches.

By measuring the quantity of distillate obtained per unit of time, it is possible to determine the corresponding degree of drying of the honeycomb core present in the furnace. With a major reduction of the distillate quantity, it can be assumed that the major portion of the solvent has been evaporated from the honeycomb core to be dried. As a result, the furnace temperature can be raised further.

Inasmuch as the phenolic resin/solvent mixture may contain up to 70 percent of a solvent or solvent mixture, the latter has to be heated again by drying in the furnace prior to the curing of the phenolic resin. Suitable solvents for dissolving phenolic resin include: low alcohols, for example, methanol, ethanol, propanol, isopropanol, butanol and its isomers, and amyl alcohol; low ketones, for example, acetone, methyl ethyl ketone, and methylvinyl ketone, or mixtures thereof, which may also contain water, if necessary.

As explained above, drying of the phenolic resin-treated honeycomb body takes place, for example, as follows:

Stage 1: 70° to 110° C.
Stage 2: to 150° C.

During the curing of the phenolic resin, the polycondensation reaction taking place releases water that is present in the air mixture exiting from the furnace. In addition, the air mixture contains phenol and its oligomers. However, removal of the phenol from the resin is not desirable. Hence, the temperature rise in the furnace is controlled so that the amount of phenol represents a minimum quantity; the consequence of said measure being that the quantity of phenolic resin adhering to the paper body, said quantity being characterized by an increase in the weight of the core, is increased. For this reason, a high volumetric weight of the paper/phenolic resin body can be obtained with the lowest number of immersions of the body. Furthermore, the resin film on the body is less stressed by the lower temperature. As a result, in the final curing step, cross-linking may occur between the individual layers that increase the material properties.

In addition to superior temperature control of the furnace, through the fractionated distillation, all auxiliary process substances, e.g., solvent, water and phenol, are recovered by the distilling with high purity and recycled into the process. The amounts of waste obtained may be reduced to less than 10 percent of those quantities obtained heretofore.

The present invention will now be described by way of the following example. It should, of course, be recognized that the following example is intended to be illustrative of the present invention and is not intended to define the limits and scope thereof.

EXAMPLE 100 g of phenolic resin is dissolved and diluted up to 50 percent with isopropanol. The starting composition of the resin, prior to the start of the drying/curing cycle, is as follows:

| | |
|---|---|
| Polyphenols or oligomers | >32% |
| Free phenol | 10 |
| Free formaldehyde | <0.5 |
| Free hexamethylenetetramine | 5 |
| Free water | <3 |
| Isopropanol | 50 |

In a first step, isopropanol is withdrawn by indirect heating with a temperature in the range of 60° to 65° C. At the furnace outlet, the isopropanol is cooled to a temperature of about −10° C.±5° C. As isopropanol forms with water, an azeotrope, the water present at the beginning is jointly withdrawn, whereupon polycondensation of the resin can start without being impaired by residual water; which impairs the overall reactivity of the monomers and oligomers. Subsequently, the furnace temperature is gradually raised, whereupon the hexamethylenetetramine starts to decompose at about 85° C. and liberates formaldehyde in situ, which represents the cross-linking agent for the free phenol and polyphenol. The temperature is further raised to about 150° C., whereupon a great amount of water is released. The water is withdrawn and cooled throughout the entire polycondensation process.

Upon completion of the curing process, two phases collect: a solid phase, which represents the cured phenol (40 g), and a liquid phase, which comprises all products resulting in the course of the drying and curing step (60 g). 50 g of the condensation products is analyzed by fractionated distillation in order to secure the optimal process parameters of the drying/curing process.

While only several embodiments of the present invention have been shown and described, it will be obvious to those or ordinary skill in art that many modifications may be made to the present invention, without departing from the sphere and scope thereof.

What is claimed is:

1. (Amended) A process for producing a phenolic resin-treated honeycomb structure having increased strength by controlling a furnace temperature in a manufacture of said phenolic resin-treated honeycomb structure, wherein said phenolic resin-treated honeycomb structure includes a plurality of paper webs which are affixed to one another and shaped to a body, comprising the steps of:

(a) immersing said body into a solution of a phenolic resin mixture;

(b) drying and curing said body in an indirectly heated furnace, subsequent to said step (a), said drying and curing step being carried out at a temperature in a range of 70° C. to 110° C.;

(c) immersing said body into a solution of a phenolic resin mixture subsequent to said drying and curing of said step (b); and, (d) drying and curing said body in an indirectly heated furnace, subsequent to said immersing step of said step (c), said drying and curing of step (d) being carried out at a temperature in a range of 145° C. to 155° C. and;

(e) condensing an air mixture exiting from said furnace, said air mixture containing a member selected from the group consisting of organic compounds, inorganic compounds and a combination thereof, in order to obtain a condensate;

(f) fractionally distilling said condensate;

(g) measuring the distillate amounts of inorganic compounds and organic compounds obtained per unit of time in order to determine the degree of drying; and (h) adjusting the temperature of the furnace to a higher temperature based upon reduced amounts of distillate of inorganic compounds and organic compounds obtained per unit of time, as measured in said measuring step.

2. The process according to claim 1, further comprising the step of repeating the sequence of said steps (a) and (b), at least one time, before carrying out said steps (c) and (d).

3. The process according to claim 2, further comprising the step of:

recycling the compounds obtained in said fractionately distilling step back into said process.

4. The process according to claim 1, further comprising the step of:

recycling the compounds obtained in said fractionately distilling step back into said process.

* * * * *